United States Patent [19]

Toussaint

[11] 4,448,444

[45] May 15, 1984

[54] POWER SUPPLY HOUSINGS FOR EXTERIOR LIGHT APPARATUS

[75] Inventor: Etienne G. Toussaint, Brussels, Belgium

[73] Assignee: Societe Anonyme des Etablissements Adrien de Backer, Brussels, Belgium

[21] Appl. No.: 281,337

[22] Filed: Jul. 8, 1981

[51] Int. Cl.[3] ..... H01F 27/02

[52] U.S. Cl. ..... 361/331; 307/150; 361/417; 336/92; 362/370

[58] Field of Search ..... 307/150, 157; 336/67, 336/68, 92, 107; 340/25, 28; 361/331, 334, 356, 417, 419, 427, 385, 332, 379, 390, 391, 429; 362/145, 153, 369, 370

[56] References Cited

U.S. PATENT DOCUMENTS

| | | | |
|---|---|---|---|
| 2,934,633 | 4/1960 | Cumming | 362/267 |
| 3,091,722 | 5/1963 | Borowiec | 361/385 |
| 3,372,325 | 3/1968 | Walgren | 361/379 |
| 3,463,913 | 8/1969 | Shavalier | 362/372 |
| 3,581,259 | 5/1971 | Brunside | 336/92 |
| 3,801,727 | 4/1974 | Wilkinson | 336/92 |
| 3,883,206 | 5/1975 | Baughman | 336/92 |
| 4,343,033 | 8/1982 | Suzuki | 362/153 |

*Primary Examiner*—G. P. Tolin
*Attorney, Agent, or Firm*—Fred A. Keire

[57] ABSTRACT

In a power supply housing having an annular flange, suspension means having a central opening therein is provided to be secured to said annular flange, and said suspension means is used to secure a power supply isolating transformer to the underside thereof such that the secondary socket of said transformer is positioned in the central opening of the suspension means for direct plug-in connection of a light source without need of a bipolar cable. An integral transformer construction is also disclosed for attachment to the suspension means as described.

2 Claims, 2 Drawing Figures

POWER SUPPLY HOUSINGS FOR EXTERIOR LIGHT APPARATUS

BACKGROUND OF THE INVENTION

The present invention relates to improvements in power supply housings for exterior lighting apparatus, e.g. aircraft guidance lights.

In some applications in the field of exterior lighting apparatus, these apparatus are supplied individually from the secondary winding of an isolating transformer having a high voltage applied across its primary winding. This is the case for instance in public lighting systems and in the field of aircraft guidance light systems.

In the aircraft guidance light systems for instance, the airport lights use isolating transformers provided with two unipolar primary cables and a bipolar secondary cable. The latter is terminated by a bipolar socket in which the bipolar connector of the supply cable of the lighting apparatus is plugged. The primary cables are to be connected through unipolar connecting cables to the isolating transformers of the adjacent lighting apparatus. These isolating transformers are generally placed at the bottom of a well or steel deep base embedded in the ground or in the runway. As water usually accumulates in these wells or deep bases coming from the cable duct system it is of common practice that the installer places a brick or the like on the bottom of said well or deep base for supporting the isolating transformer in an elevated position so as to prevent as long as possible the accumulated water to reach the transformer and the connectors. Also adhesive tape is usually set around the socket/plug junctions to prevent the risk of humidity entering up to the electrically live terminals.

SUMMARY OF THE INVENTION

To remedy this unfavorable situation, the invention has the purpose of improving the arrangement of the power supply units for such exterior lighting apparatus.

An object therefore of this invention is to provide a new power supply unit arrangement in which the isolating transformer is secured in such a manner that the secondary socket for plug-in connection of the lighting apparatus is readily accessible for direct connection of said lighting apparatus without need of bipolar secondary cable.

Another object of the invention is to provide a securing device which is readily adaptable in the existing power supply housings to have them easily modified in order to suspend the isolating transformers therein.

Yet another object of the invention is a new construction for an isolating transformer in which the primary and secondary cables are eliminated.

This invention accordingly consists in the combinational arrangement of constructional features as exemplified hereinafter.

DESCRIPTION OF EXEMPLARY EMBODIMENTS

Figure 1:
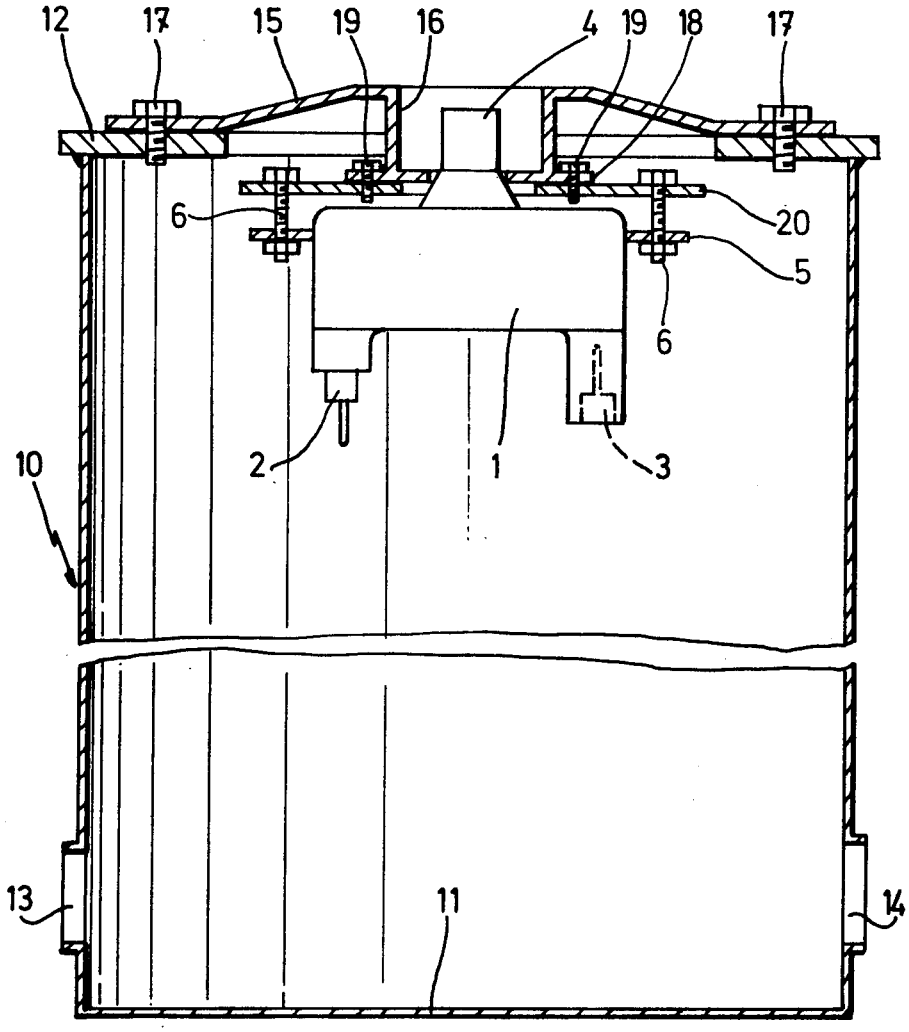
FIG. 1 is a cross-sectional view of an exemplary embodiment of an airport deep base incorporating the arrangement according to the invention.

The invention is disclosed hereinafter as applied to an airport guidance light. On FIG. 1 the reference numeral 10 denotes a usual deep base according to FAA specification L-857 to accomodate an elevated-type airport light. This base has a closed end 11 on one end an an apertured top flange 12 fixed on the other end by welding. The base 10 also has ports 13 and 14 for the passage of the power supply cables. To the annular flange 12 is secured a removable cover 15 having a threaded central opening 16 to accomodate the elevated-type light fixture (not represented). The cover 15 is secured to the flange 12 by bolts 17. The cover 15 has an annular flange 18 welded thereto in coaxial relationship with the threaded opening 16. The annular flange 18 has a number of holes for screws or bolts to secure a usual clamping ring thereto (not shown). In accordance with this invention, these holes in said annular cover flange 18 are used to secure by means of bolts 19 a support ring 20 for suspension of the power supply isolating transformer 1.

For being suspended to the removable cover 15, the isolating transormer 1 is especially realized as shown. The transformer envelope is provided with integral primary connectors 2,3 and an integral bipolar secondary socket on top thereof. The transformer envelope is also provided with attachment lugs 5 for cooperation with the support ring 20 such that when the lugs 5 are secured to said ring 20 by means of bolts 6, the secondary socket 4 is positioned in the opening of the support ring 20 for plug-in connection of the light source.

The lugs 5, besides their function of permitting attachment of the transformer 1, can be used to earth the transformer magnetic core or a point of the secondary winding thereof. By the bolts 6 being tightened, the bipolar socket 4 is urged against the inner edge of the annular cover flange 18 thereby to ensure suitable sealing.

Figure 2:
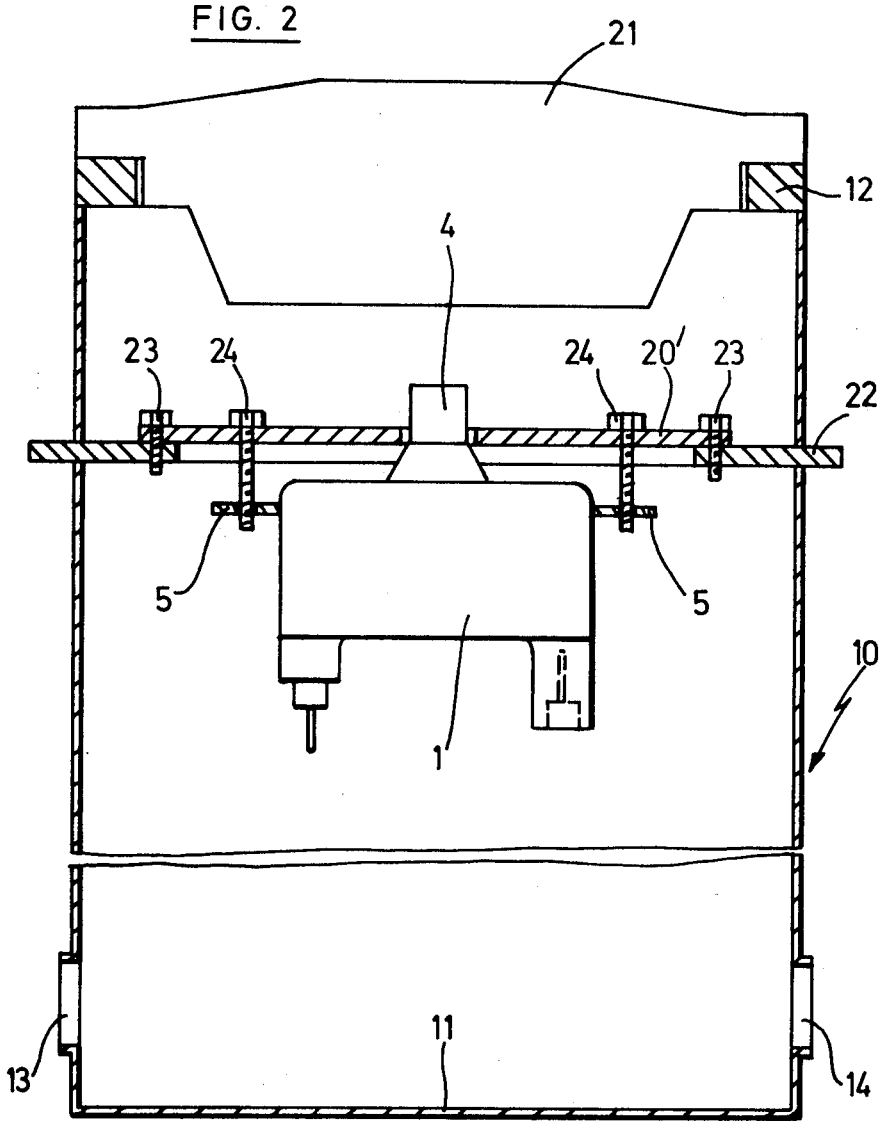
FIG. 2 is a cross-sectional view of a variant embodiment fo the unit of FIG. 1.

The arrangement according to the invention can also be carried out in a usual type II deep base (see FAA specification L-857) intended to accomodate an inset airport light. Referring to FIG. 2 there is shown in elevational section a deep base of this type. The base 10 has a closed end 11 and a top annular flange 12, said top flange 12 supporting a removable cover 21 including embedded guidance light optics known per se (not shown). The base 10 comprises an apertured middle annular flange 22 located at a distance, e.g. about 20 cm, below top flange 12. In this type II deep base, it is the apertures in the middle flange 22 which are used to secure an apertured support ring 20′ in accordance with the invention by means of bolts 23. The isolating transformer 1 is suspended to said support ring 20′ by means of the lugs 5 and bolts 24 such that the bipolar secondary socket 4 integral with the isolating transformer envelope is positioned within the opening of the support ring 20′ for plug-in connection of the light source.

It should be borne in mind as noted earlier herein that the arrangement of the invention can be carried out in other power supply housings than the exemplary airport light base application as described in the foregoing.

Also it is to be understood that the arrangement in accordance with the invention can be provided in existing power supply housings or airport light bases with the resultant advantages, as noted earlier, by simply providing and securing therein the suspension means as described in the foregoing and to provide an integral isolating transformer arranged for being suspended to said suspension means. Advantageously, the attachment means provided integral with the transformer envelope for the suspension of the transformer are arranged to serve for earthing the transformer magnetic core or a point of the secondary winding thereof.

What is claimed is:

1. In an airport light deep base intended for an elevated-type light, said deep base having a removable base plate cover with a central opening fitted with a tapped hole used to secure the elevated light and ending at a ring flange having a central opening located coaxially with said cover central opening, said ring flange having a plurality of apertures therein, the improvement comprising a suspended isolating transformer including an envelope having moulded primary plug and receptacle terminal means at its lower end, moulded secondary receptacle terminal means at its upper end adapted to fit a feeder of the light, and apertured attachment means; and suspension means comprising a support ring secured to the ring flange and having a central opening that is coaxially disposed with respect to the cover central opening, said support ring having apertures arranged around the central opening which cooperate with apertures in the transformer attachment means via securing members and suspend the isolating transformer away from the bottom of said deep base and position the moulded secondary terminal means within the cover central opening and thereby allow the direct plug-in of the light feeder into said secondary terminal means.

2. In an airport light deep base intended for an inset type light, said deep base having a removable cover including embedded guidance light optics and a middle apertured ring flange at a distance from said removable cover, the improvement comprising a suspended isolating transformer including an envelope having moulded primary plug and receptacle terminal means at its lower end, moulded secondary receptacle terminal means at its upper end adapted to fit a feeder of the light, and apertured attachment means; and suspension means comprising a support ring secured to said ring flange and having a central opening that is disposed coaxially with respect to the ring flange central opening, said support ring having apertures arranged around the central opening which cooperate with apertures in the transformer attachment means via securing members and suspend the isolating transformer away from the bottom of said deep base and position the moulded secondary terminal means within the cover central opening and thereby allow the direct plug-in of the light feeder into said secondary terminal means.

* * * * *